US009580853B2

(12) United States Patent
Son et al.

(10) Patent No.: US 9,580,853 B2
(45) Date of Patent: Feb. 28, 2017

(54) AUXILIARY WASHING MACHINE AND CLOTHES TREATMENT APPARATUS USING THE SAME

(71) Applicant: LG ELECTRONICS INC., Seoul (KR)

(72) Inventors: Seyul Son, Seoul (KR); Dongwon Kim, Seoul (KR); Dongsoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 508 days.

(21) Appl. No.: 13/974,264

(22) Filed: Aug. 23, 2013

(65) Prior Publication Data

US 2014/0053612 A1 Feb. 27, 2014

(30) Foreign Application Priority Data

Aug. 23, 2012 (KR) ..... 10-2012-0092445
Jan. 16, 2013 (KR) ..... 10-2013-0004677
Jan. 16, 2013 (KR) ..... 10-2013-0004678

(51) Int. Cl.
*D06F 31/00* (2006.01)
*D06F 29/00* (2006.01)
(Continued)

(52) U.S. Cl.
CPC ..... *D06F 31/00* (2013.01); *D06F 29/00* (2013.01); *D06F 37/20* (2013.01); *D06F 37/24* (2013.01)

(58) Field of Classification Search
CPC ..... D06F 31/00; D06F 29/00; D06F 29/005; D06F 37/20; D06F 37/24
See application file for complete search history.

(56) References Cited

U.S. PATENT DOCUMENTS 5,606,879 A * 3/1997 Froelicher ..... D06F 37/20 188/129
8,561,438 B2 * 10/2013 Jeong ..... D06F 31/00 68/13 R
(Continued)

FOREIGN PATENT DOCUMENTS

CN 101451295 A 6/2009
CN 101578409 A 11/2009
(Continued)

OTHER PUBLICATIONS

European Search Report issued in related Application No. 13181505.2 dated Jan. 31, 2014.
(Continued)

*Primary Examiner* — David Cormier
(74) *Attorney, Agent, or Firm* — Ked & Associates, LLP

(57) ABSTRACT

Provided is a washing machine which may include a cabinet that defines an accommodation space, a washing device configured to be withdrawn from the accommodation space of the cabinet, and a front panel provided in front of the washing device that defines a front external appearance of the auxiliary washing machine. The washing device may include a drawer configured to be slidably inserted or withdrawn from the accommodation space of the cabinet, the drawer including a tub for wash water, a rotating drum assembly provided in the drawer, the rotating drum assembly having a drum and a rotating shaft connected to the drum and extending through the tub, and a suspension assembly configured to support a vertical load of the rotating drum assembly such that the rotating drum assembly is suspended relative to the tub and to dampen vibration from the rotating drum assembly in a lateral direction.

20 Claims, 14 Drawing Sheets

(51) Int. Cl.
*D06F 37/20* (2006.01)
*D06F 37/24* (2006.01)

(56) References Cited

U.S. PATENT DOCUMENTS

| | | | | |
|---|---|---|---|---|
| 2004/0074263 | A1 | 4/2004 | Chang | 68/12.06 |
| 2006/0075824 | A1 | 4/2006 | Kishimoto et al. | |
| 2008/0289368 | A1 | 11/2008 | Braz et al. | 68/13 |
| 2009/0139273 | A1 | 6/2009 | Kim et al. | 68/23.1 |
| 2009/0139275 | A1 | 6/2009 | Kim et al. | 68/27 |
| 2010/0307200 | A1 | 12/2010 | Jeong et al. | |
| 2011/0214458 | A1 | 9/2011 | Lim et al. | |
| 2011/0265524 | A1 | 11/2011 | Kim et al. | 68/13 |
| 2014/0053612 | A1 | 2/2014 | Son et al. | |

FOREIGN PATENT DOCUMENTS

| | | |
|---|---|---|
| CN | 101617077 A | 12/2009 |
| CN | 102844486 | 12/2012 |
| EP | 0 808 933 | 11/1997 |
| WO | WO 2008/069607 | 6/2008 |
| WO | WO 2008/084932 | 7/2008 |
| WO | WO 2009/134018 A2 | 11/2009 |

OTHER PUBLICATIONS

International Search Report issued in related International Application No. PCT/KR2013/007576 dated Dec. 18, 2013.
European Search Report issued in Application No. 13188289.6 dated Jun. 11, 2014.
International Search Report issued in related International Application No. PCT/KR2013/008523 dated Apr. 7, 2014.
U.S. Office Action issued in a co-pending U.S. Appl. No. 14/037,425 dated Jun. 26, 2015.
Chinese Office Action dated Jan. 15, 2016 issued in Application No. 201380028404.5. (English Translation attached).
U.S. Office Action dated Aug. 11, 2016 issued co-pending U.S. Appl. No. 14/037,425.
Chinese Office Action dated Jun. 3, 2016 issued in Application No. 201380069163.9 (English translation attached).

* cited by examiner

AUXILIARY WASHING MACHINE AND CLOTHES TREATMENT APPARATUS USING THE SAME

CROSS-REFERENCE TO RELATED APPLICATION(S)

This application claims priority under 35 U.S.C. §119 to Korean Application No. 10-2012-0092445 filed in Korea on Aug. 23, 2012; Korean Application No. 10-2013-0004677 filed in Korea on Jan. 16, 2013; and Korean Application No. 10-2013-0004678 filed in Korea on Jan. 16, 2013, whose entire disclosures are hereby incorporated by reference.

BACKGROUND

1. Field

The present disclosure relates to a laundry treatment apparatus, and more particularly to an auxiliary washing machine, which is added to a main washing machine and serves to treat laundry, and a laundry treatment apparatus using the same.

2. Background

Laundry treatment apparatuses having main and auxiliary washing machines are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

In the following description of the present disclosure, names of respective components are defined taking into consideration the functions obtained in accordance with the present disclosure. Accordingly, these names should not be understood as meanings that limit technical components of the present disclosure. In addition, the defined names of the respective components may be replaced by other names known in the art.

In addition, clothes and laundry mentioned herein may include objects that a person can wear, such as, for example, shoes, socks, gloves, caps, garments and dresses. In particular, laundry may include all objects that will be subjected to washing.

In general, a laundry treatment apparatus (or clothes treatment apparatus) is an apparatus that washes laundry using detergent and mechanical friction. Typically, a general laundry treatment apparatus is directly installed on the floor. Among various laundry treatment apparatuses, however, in the case of a front loading type laundry treatment apparatus (so-called drum washing machine) in which laundry is introduced from the front side thereof, an opening for introduction of laundry is provided at a relatively low position. Hence, a user may inconveniently need to bend their body when stowing or retrieving laundry.

To remove the above-described inconvenience, a stand, which may be added to the bottom of the front loading type laundry treatment apparatus and functions to raise a substantial installation position of the laundry treatment apparatus, has been developed. In addition, technologies in which the stand is not simply used as a support, but is additionally equipped with an auxiliary washing machine to enable washing of a small quantity of laundry have been developed.

Hereinafter, a laundry treatment apparatus according to the related art will be described in brief with reference to the accompanying drawing.

Figure 1:
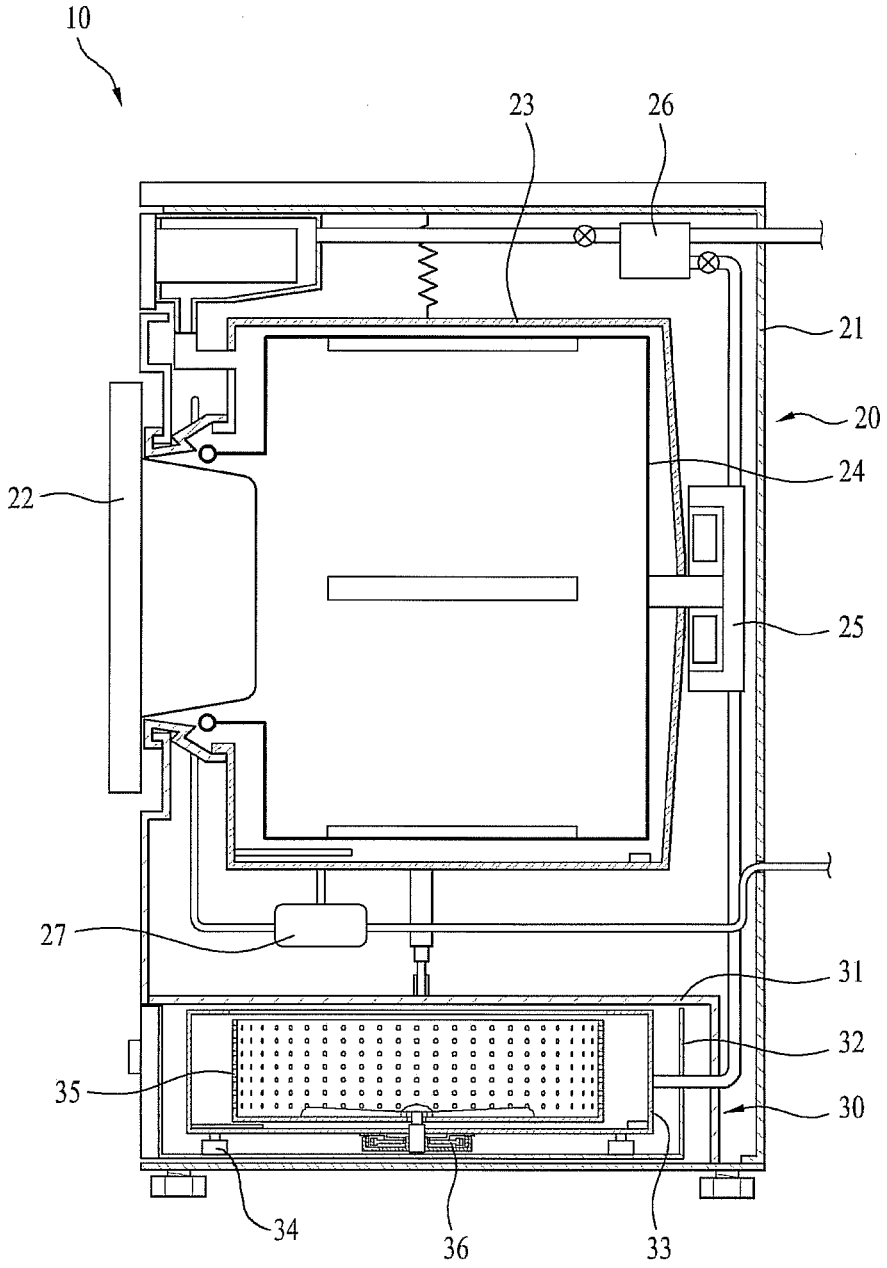
FIG. 1 is a sectional view showing an internal configuration of a laundry treatment apparatus according to the related art.

As exemplarily shown in FIG. 1, in the case of the laundry treatment apparatus 10, an auxiliary washing machine 30 may be integrally or separately installed to, for example, the bottom of a main washing machine 20. Here, the main washing machine 20 may be a front loading type washing machine (e.g., drum washing machine) into which laundry is introduced from the front side thereof, and the auxiliary washing machine 30 may be a top loading type washing machine (e.g., barrel washing machine), which is configured to be withdrawn like a drawer such that laundry is introduced from the upper side thereof.

More specifically, the main washing machine 20 includes, for example, a cabinet 21 that defines an external appearance of the main washing machine and is equipped with a door 22 for introduction of laundry, a tub 23 that is placed within the cabinet 21 and configured to store wash water therein, a drum 24 that is rotatably placed within the tub 23 and configured to accommodate laundry such that the laundry is washed therein, a motor 25 that is placed at the outside of the tub 23 and serves to rotate the drum 24 connected to a rotating shaft 24*a*, a water supply unit 26 that is used to supply wash water into the tub 23, and a drain unit 27 that is used to discharge spent wash water after completion of washing.

The auxiliary washing machine 30 includes a cabinet 31 that is placed below the main washing machine 20 and has a shape corresponding to the main washing machine 20, a drawer 32 that is withdrawn forward from the cabinet 31, a tub 33 that is separable from the drawer 32 and configured to store wash water therein, a rotating tub 35 (or rotating drum) that is placed within the tub 33 and serves to wash laundry, and a motor 36 that is mounted to the bottom of the tub 33 and serves to rotate the rotating tub 35. In addition, a plurality of dampers 34, which is used to elastically support the tub 33, may be provided to prevent vibration generated via rotation of the rotating tub 35 from being transmitted to the drawer 32 through the tub 33.

The auxiliary washing machine 30 as described above may be provided above or below the main washing machine 20, and provide the user with various additional functions. In addition, the auxiliary washing machine 30 may be integrated with the main washing machine 20, or may be configured as an independent washing machine.

Usually, the above-described auxiliary washing machine 30 may be located below the main washing machine 20 and has the main purpose of raising an installation position of the main washing machine 20. In addition, the auxiliary washing machine 30 typically has a smaller capacity than that of the main washing machine 20 to allow the user to economically wash a small quantity of laundry. The washing capacity of the auxiliary washing machine 30 is limited by the size of the main washing machine 20.

Accordingly, the auxiliary washing machine 30 has a relatively small size that is limited by the size of the main washing machine 20, and thus, has structural difficulty in increasing the washing capacity thereof.

Moreover, in the case of the above-described auxiliary washing machine 30, the tub 33 and the drawer 32 must be maintained in a separated state. This is because vibration generated via rotation of the rotating tub 35 is transmitted to the tub 33, causing vibration of the tub 33, and in turn vibration of the tub 33 is transmitted to the drawer 32.

Hence, it is necessary to provide a clearance between the tub 33 and the drawer 32 to allow the tub 33 to vibrate and move relative to the drawer 32. In addition, to prevent vibration of the rotating tub 35 from being transmitted to the drawer 32 through the tub 33, providing the dampers 44 that support the tub 33 and absorb vibration of the tub 33 between the drawer 32 and the tub 33 is essential.

As described above, the clearance provided for vibration and movement of the tub 33 relative to the drawer 32 and the dampers 34 configured to absorb vibration of the tub 33 utilize an interior space of the drawer 32, which reduces the capacity of the tub 33 of the auxiliary washing machine 30. Consequently, the auxiliary washing machine 30 may have difficulty in increasing the washing capacity thereof due to the structural limit.

Figure 2:
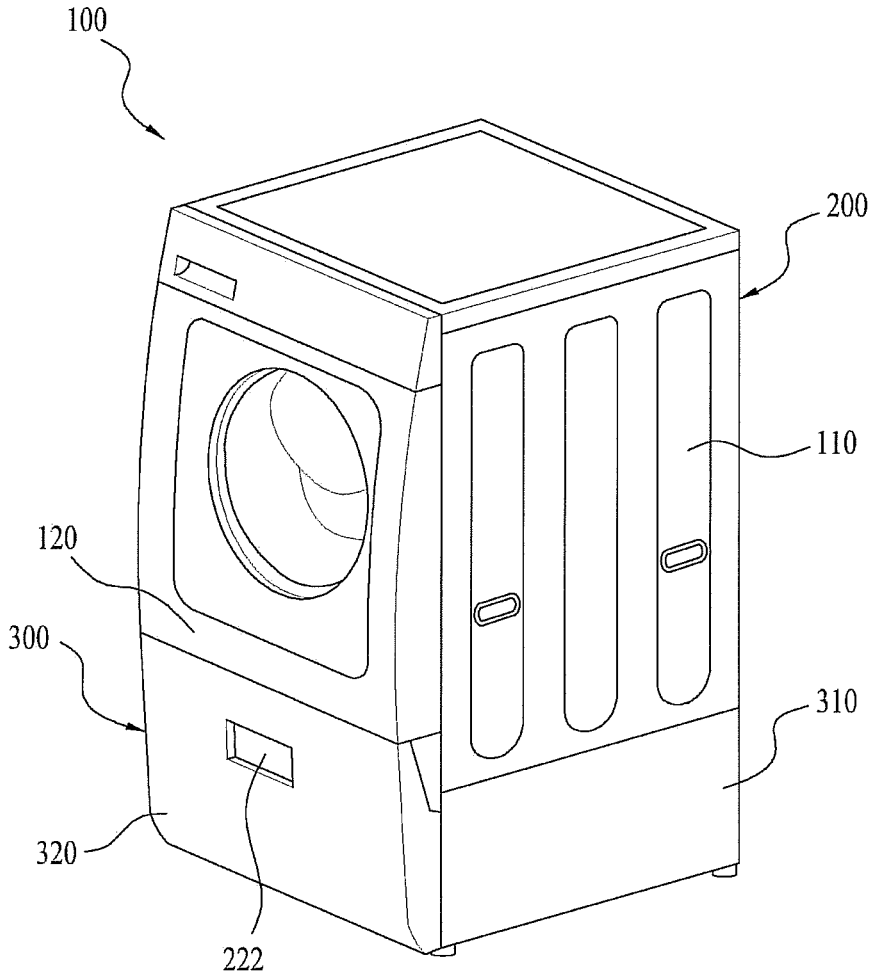
FIG. 2 is a perspective view showing a laundry treatment apparatus according to an embodiment of the present disclosure.

FIG. 2 is a perspective view showing the laundry treatment apparatus according to an embodiment of the present disclosure. The laundry treatment apparatus 100 may include a main washing machine 200 and an auxiliary washing machine 300 provided at one side of or below the main washing machine 200. Here, the main washing machine 200 may include a first cabinet 110 defining an external appearance of the main washing machine 200, and the auxiliary washing machine 300 may include a second cabinet 310 defining an external appearance of the auxiliary washing machine 300.

The main washing machine 200 may include a first tub and/or a first drum in which wash water is stored and used to wash laundry, more particularly, to wash and dry laundry. Likewise, the auxiliary washing machine 300 may include a tub structure 420 (see FIG. 5) in which wash water is stored and a rotating tub 430, or drum (see FIG. 5). Here, the auxiliary washing machine 300 may be located adjacent to the main washing machine 200. In an exemplary example, the auxiliary washing machine 300 may be located below the main washing machine 200 for convenience of a user who mainly uses the main washing machine 200. That is, the auxiliary washing machine 300 may function to raise an installation position of the main washing machine 200 to enhance user convenience.

In the case in which the auxiliary washing machine 300 is provided along with the main washing machine 200 that washes laundry, the main washing machine 200 and the auxiliary washing machine 300 may have the same washing capacity. Otherwise, in consideration of restrictions in the installation space of the laundry treatment apparatus 100, manufacturing costs of the laundry treatment apparatus 100, and the like, one of the main washing machine 200 and the auxiliary washing machine 300 may have a smaller capacity than the other.

In the present embodiment, as exemplarily shown in the drawing, at least one of the washing capacity, volume, and height of the auxiliary washing machine 300 may be less than that of the main washing machine 200. As such, the user may appropriately select and use one of the main washing machine 200 and the auxiliary washing machine 300 according to the quantity of laundry.

In washing, the user may select one of the main washing machine 200 and the auxiliary washing machine 300 according to the kind of laundry. For example, if laundry includes baby clothes, underwear, and the like that need to be washed in isolation and are small in quantity, the auxiliary washing machine 300 may be selected to wash the laundry, and the main washing machine 200 may be used to wash the other laundry.

In the case in which the auxiliary washing machine 300 has a smaller washing capacity than that of the main washing machine 200, the auxiliary washing machine 300 may be provided below the main washing machine 200. Arranging the auxiliary washing machine 300 below the main washing machine 200 may raise the height of the main washing machine 200, which may assist the user in more easily stowing laundry in or retrieving laundry from the main washing machine 200.

In the case in which the laundry treatment apparatus 100 includes the main washing machine 200 and the auxiliary washing machine 300, the first cabinet 110 for installation of the main washing machine 200 and the second cabinet 310 for installation of the auxiliary washing machine 300 may be individually manufactured and then coupled to each other. In this case, a typical drum washing machine or barrel washing machine may be selectively used as the main washing machine 200.

Alternatively, in consideration of ease in manufacture, and the like, the first cabinet 110 for installation of the main washing machine 200 and the second cabinet 310 for installation of the auxiliary washing machine 300 may be integrated with each other to construct a single cabinet. That is, a single cabinet may be provided such that both the main washing machine 200 and the auxiliary washing machine 300 are accommodated in the cabinet. In this case, to distinguish the main washing machine 200 and the auxiliary washing machine 300 from each other, a partition may be provided therebetween.

Hereinafter, an embodiment in which both the main washing machine 200 and the auxiliary washing machine 300 are constructed respectively using the first cabinet 110 and the second cabinet 310 will be described. However, it should be appreciated that the embodiment does not exclude integration of the first cabinet 110 and the second cabinet 310.

The main washing machine 200 as described above may include a door 120 configured to be selectively opened. The user may open the door 120 and stow laundry in the main washing machine 200. The main washing machine 200 may be a typical drum washing machine or barrel washing machine, and therefore a detailed description of the configuration of the main washing machine 200 will be omitted hereinafter.

In the case in which the main washing machine 200 and the auxiliary washing machine 300 are installed in a single cabinet, the main washing machine 200 and the auxiliary washing machine 300 may share common components of the main washing machine 200 and the auxiliary washing machine 300 (for example, a controller, a water supply unit, and a drain unit, etc.). This sharing configuration is acquired via simple design change, and thus a detailed description of this will be omitted herein.

The auxiliary washing machine 300 may include a variety of components for washing that will be described hereinafter. It should be appreciated that these components may be configured to be easily accessible from the outside for user convenience, repair and maintenance, and the like.

For example, as exemplarily shown, the auxiliary washing machine 300 may include a slidable drawer-shaped washing unit 400. As the washing unit 400 is forwardly slidable, the user may easily pull the washing unit 400 forward when using the auxiliary washing machine 300.

Figure 3:
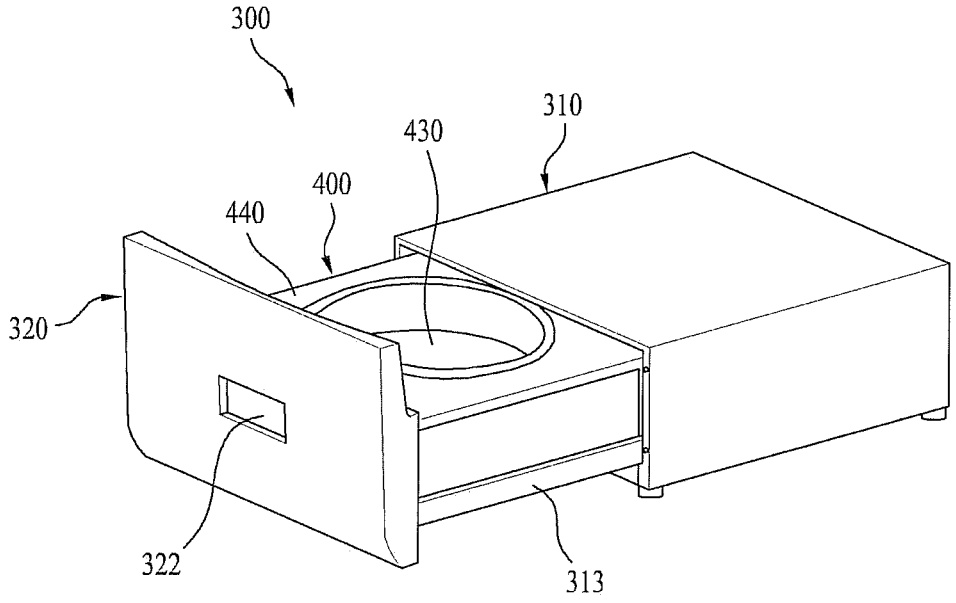
FIG. 3 is a perspective view showing an auxiliary washing machine according to an embodiment of the present disclosure.

Hereinafter, the auxiliary washing machine 300 of the present disclosure will be described in detail with reference to the accompanying drawings. FIG. 3 is a perspective view showing the auxiliary washing machine according to an embodiment of the present disclosure, and FIG. 4 is a perspective view showing major components of the auxiliary washing machine according to the embodiment of the present disclosure.

Figure 4:
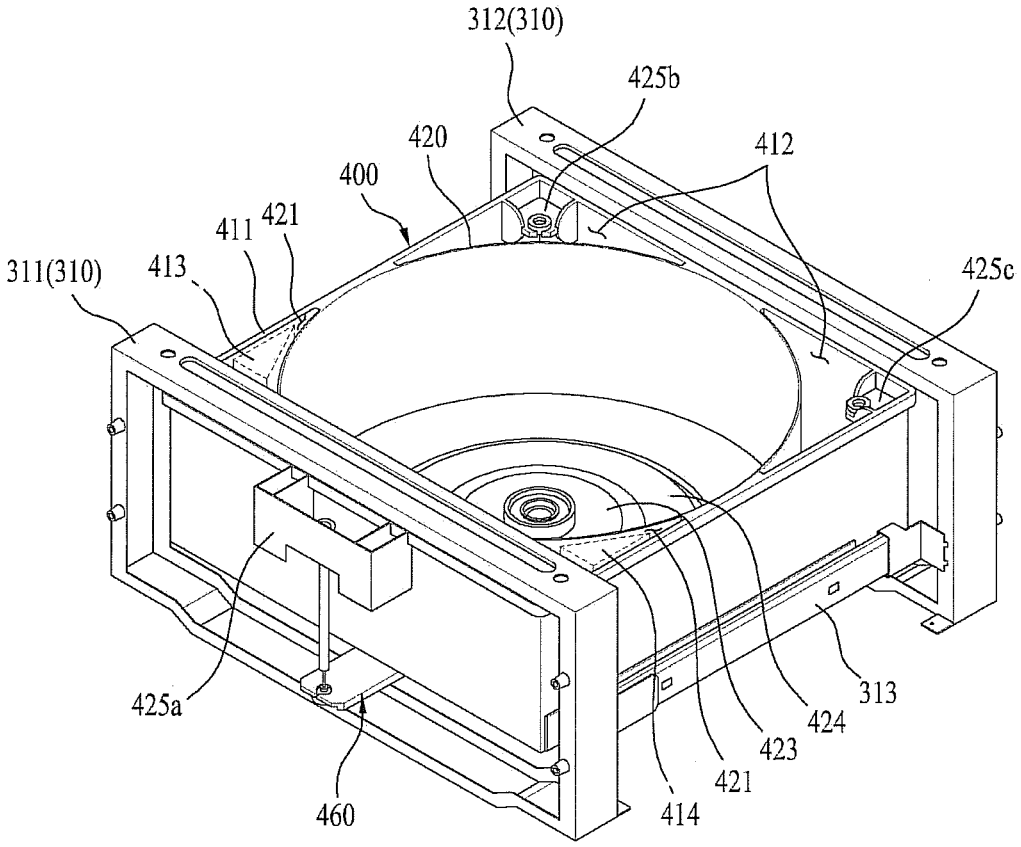
FIG. 4 is a perspective view showing major components of the auxiliary washing machine according to an embodiment of the present disclosure.

As exemplarily shown in FIGS. 3 and 4, the auxiliary washing machine according to the present disclosure includes the second cabinet 310 that defines an external appearance of the auxiliary washing machine 300, front and rear frames 311 and 312 that are placed within the second cabinet 310 and function to maintain the shape of the second cabinet 310 and to define an accommodation space for the washing unit 400 (or washing device), and the washing unit 400 that is withdrawn forward from the second cabinet 310.

A front panel 320 may be placed in front of the washing unit 400 and define a front external appearance of the auxiliary washing machine 300. The front panel 320 may be equipped with a handle to assist the user in withdrawing the washing unit 400. In addition, the front panel 320 may be equipped at an inner surface thereof with a locking device. The locking device may be caught by the second cabinet 310 when the washing unit 400 is inserted into the accommodation space of the second cabinet 310.

The washing unit 400, as described above, is movable in a sliding manner through an entrance/exit opening of the second cabinet 310 so as to open or close the second cabinet 310. To this end, a pair of lateral rail units 313 is provided respectively at both lateral sides of the washing unit 400 and serves to guide the washing unit 400 such that the washing unit 400 is withdrawn outward relative to the front and rear frames 311 and 312. In addition, a lower rail unit (315, see FIG. 12) may be provided at a lower surface of the washing unit 400.

The lateral rail units 313 and the lower rail unit as described above may be secured to the front and rear frames 311 and 312 via separate fastening members, and may be fixed in position between the front frame 311 and the rear frame 312 so as to extend in a withdrawal/insertion direction of the washing unit 400.

The lateral rail units 313 are used to guide withdrawal and insertion of the washing unit 400 while restricting upward/downward movement of the washing unit 400. In addition, the lower rail unit 315, which is provided between the lower surface of the washing unit 400 and the second cabinet 310, is used to guide withdrawal and insertion of the washing unit 400 while restricting leftward/rightward movement of the washing unit 400.

The washing unit 400 of the auxiliary washing machine 300 may have a configuration suitable for use in a top loading type laundry treatment apparatus. In the case of the auxiliary washing machine 300 for use in the top loading type laundry treatment apparatus, a rotating shaft 431 of the rotating tub 430 is oriented perpendicular to the ground. As such, rotation of the rotating tub 430 causes vibration throughout the horizontal direction. In particular, this vibration is significant during dehydration (e.g., spin cycle), and more greatly occurs when laundry is eccentrically located within the rotating tub 430.

The washing unit 400 has only 1 degree of freedom as it is movable in a front-and-rear direction by the pair of lateral rail units 313. In other words, upward/downward movement of the washing unit 400 is restricted by the lateral rail units 313, and moreover, leftward/rightward movement of the washing unit 400 may be restricted. However, to achieve ease in withdrawal of the washing unit 400, each of the lateral rail units 313 is spaced apart from a corresponding installation portion by a predetermined distance in a left-and-right direction of the washing unit 400. Such predetermined distance spacing, however, causes the washing unit 400 to move and vibrate leftward and rightward when vibration of the rotating tub 430 is transmitted to a drawer 410. This vibration deteriorates durability of the washing unit 400 and results in generation of noise.

Through provision of the lower rail unit 315, it is possible to restrict lateral vibration of the washing unit 400. More specifically, the lower rail unit 315 may serve not only to guide insertion and withdrawal of the washing unit 400, but also to restrict leftward and rightward vibration of the washing unit 400. Accordingly, it is possible to enhance durability of the laundry treatment apparatus 100 and to reduce noise.

In the auxiliary washing machine 300 according to the embodiment of the present disclosure, the washing unit 400 may be completely withdrawn outward from the second cabinet 310. More specifically, when repairing the washing unit 400 or other inner elements of the auxiliary washing machine 300, it is possible to separate the washing unit 400 from the second cabinet 310, which ensures easy repair.

Figure 5:
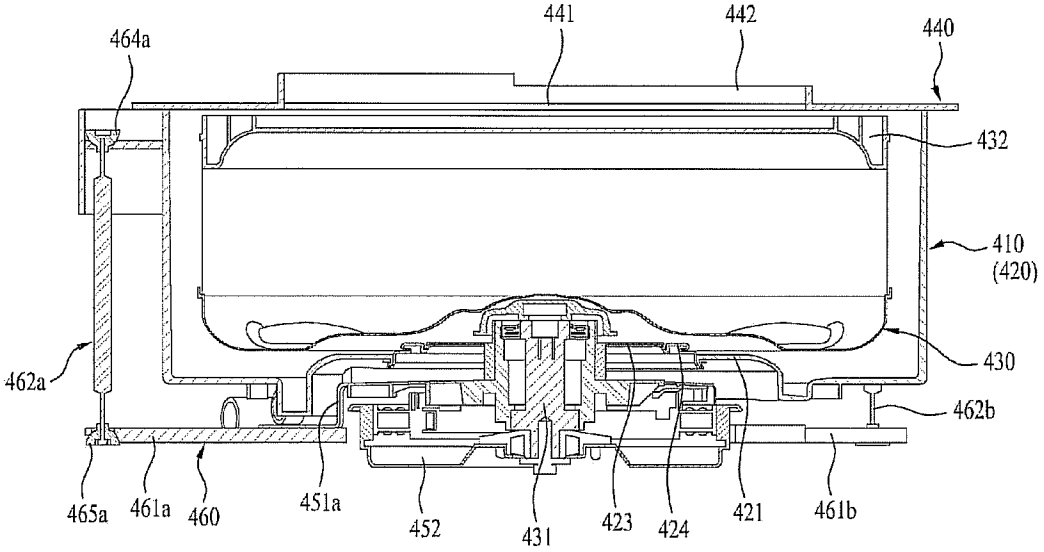
FIG. 5 is a partial sectional view showing inner components of a washing unit included in the auxiliary washing machine according to an embodiment of the present disclosure.

Hereinafter, the washing unit 400 of the auxiliary washing machine according to an embodiment of the present disclosure will be described in detail with reference to the accompanying drawings. FIG. 5 is a partial sectional view showing inner components of the washing unit included in the auxiliary washing machine according to an embodiment of the present disclosure, and FIG. 6 is an exploded perspective view showing components of the washing unit included in the auxiliary washing machine according to the embodiment of the present disclosure.

Figure 6:
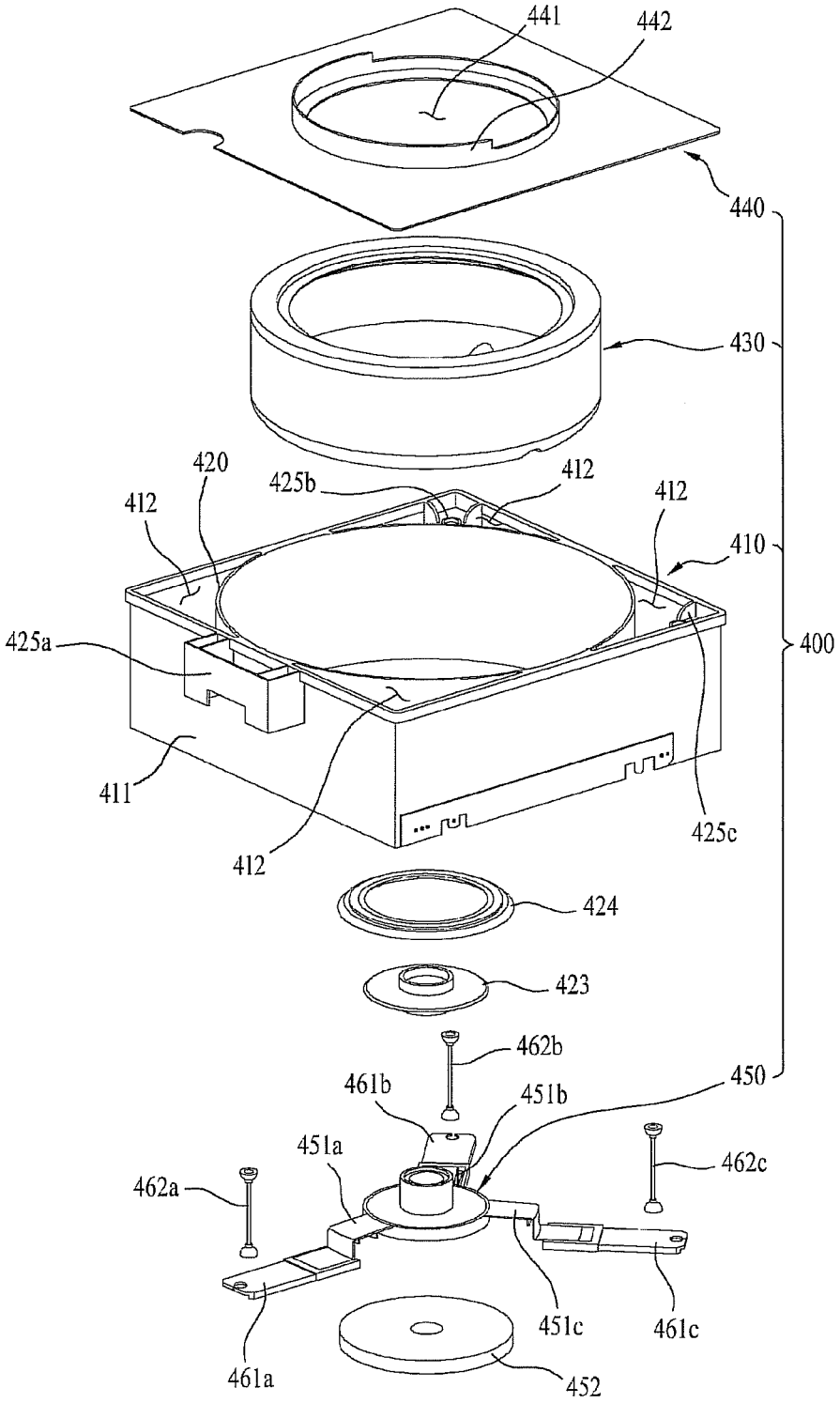
FIG. 6 is an exploded perspective view showing components of the washing unit included in the auxiliary washing machine according to an embodiment of the present disclosure.

As exemplarily shown in FIGS. 5 and 6, the washing unit 400 includes the drawer 410 integrated with the tub structure 420 in which wash water is stored, the rotating tub 430 rotatably placed within the tub structure 420, a drawer cover 440 that is provided at the top of the drawer 410 and configured to shield the drawer 410, a bearing housing 450 configured to support the rotating tub 430 such that the rotating tub 430 is movable independently of the drawer 410, a motor 452 that is installed to the bearing housing 450 and serves to rotate the rotating tub 430, a suspension assembly 460 configured to support the bearing housing 450, and a water supply/drain unit 413 (see FIG. 13) that is extended and contracted according to movement of the drawer 410.

The drawer 410 includes a drawer body 411 in the form of a box to be inserted into the accommodation space for the drawer 410 that is defined by the second cabinet 310 and the front and rear frames 311 and 312, and the cylindrical tub structure 420 placed within the drawer body 411 for storage of wash water.

In an exemplary configuration, the drawer body 411 may take the form of a rectangular column, upper and lower ends of which are open, and the tub structure 420 may be integrated with the drawer 410 in such a manner that an outer circumferential surface of the tub structure 420 comes into contact with an inner surface of the drawer body 411. In addition, four drawer spaces 412 are defined between four corners of the drawer body 411 and the outer circumferential surface of the tub structure 420.

First, second and third holders 425*a*, 425*b* and 425*c*, which are coupled to the suspension assembly 460 that will be described hereinafter, are provided respectively at a front surface of the drawer body 411 and in the drawer spaces 412 defined at both rear corners of the drawer body 411. The first holder 425*a* protrudes outward from the front surface of the drawer body 411. The second and third holders 425*b* and 425*c* are located in the drawer spaces 412 defined at both rear corners of the drawer body 411. The first, second and third holders 425*a*, 425*b* and 425*c* may have the same semispherical recess (426*a*, see FIG. 9), although they have a difference in terms of installation positions. The semispherical recess 426*a*, formed in each of the first, second and third holders 425*a*, 425*b* and 425*c*, is centrally provided with a through-hole 427*a*. First, second, and third support bars 462*a*, 462*b* and 462*c* (see FIG. 9) of the suspension assembly 460 that will be described hereinafter are respectively placed in the respective semispherical recesses 426*a* of the first, second, and third holders 425*a*, 425*b* and 425*c*.

The drawer spaces 412 defined at both front corners of the drawer body 411 may be utilized as spaces for installation of other components of the auxiliary washing machine 300. For example, the drain unit 413 (more particularly, a drain pump (not shown), a drain filter (not shown), and the like) and a controller 414 (more particularly, a Printed Circuit Board (PCB)) may be installed.

The drawer spaces 412 defined at both front corners of the drawer body 411, particularly, may have a blind bottom for easy installation of components installed in the front drawer spaces 412. Alternatively, the front drawer spaces 412 may have a partially or wholly open bottom. If the bottom of the drawer space 412 is partially or wholly open, the open bottom may serve as a drain space for drainage of wash water overflowing from the tub structure 420 or wash water separated from the components installed in the drawer space 412.

Figure 7:
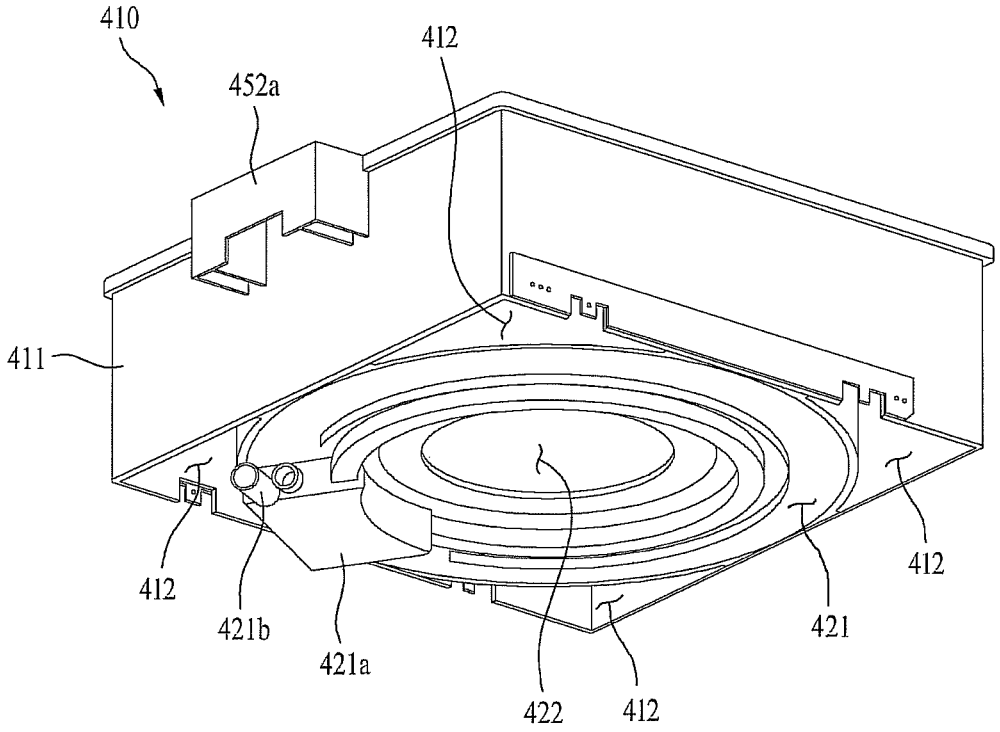
FIG. 7 is a bottom perspective view showing a drawer of the washing unit included in the auxiliary washing machine according to an embodiment of the present disclosure.

Hereinafter, the tub structure 420 will be described with reference to FIGS. 6 and 7. FIG. 7 is a bottom perspective view showing the drawer of the washing unit included in the auxiliary washing machine according to the embodiment of the present disclosure.

As exemplarily shown in FIGS. 6 and 7, the tub structure 420 is integrated with the drawer body 411. In an exemplary configuration, the drawer body 411 and the tub structure 420 may be integrally injection molded. The tub structure 420 takes the form of a vertical cylinder, an outer circumferential surface of which comes into contact with the inner surface of the drawer body 411. When the outer circumferential surface of the tub structure 420 comes into contact with the inner surface of the drawer body 411, the capacity of the tub structure 420 may be maximized. The top of the tub structure 420 is open for introduction of laundry and wash water. The tub structure 420 has a ring-shaped bottom portion 421 that centrally defines an aperture 422 (or opening). A moving piece 423 (or rotatable device) is located in the aperture 422 such that an outer circumferential surface of the moving piece 423 is spaced apart from an inner circumference of the aperture 422. A moving gasket 424 is fitted around the moving piece 423 and serves to seal a gap between the aperture 422 and the moving piece 423 while allowing the moving piece 423 to be movable relative to the aperture 422. The rotating shaft 431 of the rotating tub 430 is inserted through the center of the moving piece 423.

The bottom portion 421 of the tub structure 420 is equipped with a drain sump 421*a* to discharge wash water stored in the tub structure 420. The drain sump 421*a* takes the form of a chamber indented in the bottom portion 421. In addition, the bottom portion 421 may be inclined toward the drain sump 421*a* to facilitate drainage of wash water.

The drain sump 421*a* has a drain port 421*b* provided at one side thereof, to which a drainpipe for drainage of wash water is connected. The bottom of the drain sump 421*a* is inclined toward the drain port 421*b* to facilitate drainage of wash water. In addition, a heater 421*c* may further be provided in the drain sump 421*a* to heat wash water stored in the tub structure 420.

As described above, the moving gasket 424 is interposed between the inner circumference of the aperture 422 perforated in the bottom portion 421 of the tub structure 420 and the outer circumferential surface of the moving piece 423. The moving gasket 424 functions to allow the moving piece 423 to be moved relative to the tub structure 420. In addition, the moving gasket 424 functions to continuously seal the gap between the inner circumference of the aperture 422 and the outer circumferential surface of the moving piece 423.

The moving gasket 424 may take the form of a rubber ring to hermetically seal the gap between the inner circumference of the aperture 422 and the outer circumferential surface of the moving piece 423. In an exemplary configuration, the moving gasket 424 may have a plurality of ring-shaped pleats to allow movement of the moving piece 423.

Referring again to FIGS. 5 and 6, the rotating tub 430 is rotatably placed within the tub structure 420. The rotating tub 430 takes the form of a cylindrical vessel spaced apart from the tub structure 420 by a predetermined distance. The rotating tub 430 has a plurality of dehydration holes perforated in a circumferential wall thereof for discharge of wash water during dehydration. The rotating tub 430 further has bosses formed at an inner bottom surface thereof. These bosses serve to facilitate movement of wash water and laundry. A balancer 432 (e.g., FIG. 5) is mounted to the circumference of a top opening of the rotating tub 430 and serves to compensate for eccentricity of the rotating tub 430. The balancer 432 may be a liquid balancer or ball balancer. The rotating shaft 431 is connected to the bottom of the rotating tub 430. The rotating shaft 431 penetrates the moving piece 423 of the tub structure 420 to thereby be supported by the bearing housing 450. As such, the rotating shaft 431 is rotated by the motor 452 provided at the bearing housing 450.

Although the embodiment of the present disclosure illustrates and describes the auxiliary washing machine using the rotating tub 430, alternatively, a pulsator to apply rotational force to wash water stored in the tub structure 420 may be provided at the bottom of the tub structure 420.

The drawer cover 440 is placed at the top of the drawer 410 to shield the respective drawer spaces 412 of the drawer body 411. The drawer cover 440 has a central opening 441, through which laundry is introduced into the rotating tub 430. Additionally, wash water may be introduced through the opening 441. A multi-stepped rib 442 is formed on the circumference of the opening 441 of the drawer cover 440. The multi-stepped rib 442 is used to close the opening 441 once the washing unit 400 has been accommodated. The multi-stepped rib 442 takes the form of a cylindrical wall protruding upward from the opening 441 and is downwardly stepped in an insertion direction of the washing unit 400.

A multi-stepped lid 314 (e.g., FIG. 8) is formed at an inner ceiling surface of the second cabinet 310. The multi-stepped lid 314 is configured to shield the opening 441 by coming into contact with the multi-stepped rib 442 once the washing unit 400 has been accommodated. As the washing unit 400 is inserted into the second cabinet 310, the multi-stepped lid 314 is brought into close contact with the multi-stepped rib 442 of the drawer cover 440 that is located at the top of the drawer 410, thereby shielding the opening 441 of the drawer cover 440. To this end, the multi-stepped lid 314 is downwardly stepped in an insertion direction of the drawer 410. In brief, the multi-stepped rib 442 and the multi-stepped lid 314 come into close contact with each other as the washing unit 400 is inserted, thereby shielding the opening of the drawer cover 440.

Alternatively, the multi-stepped rib 442 formed at the drawer cover 440 may be replaced by an inclined rib. More specifically, the inclined rib may take the form of a cylindrical wall protruding upward from the opening 441 and may be downwardly inclined in an insertion direction of the drawer 410. In this case, the multi-stepped lid 314, which is formed at the inner ceiling surface of the second cabinet 310, may be replaced by an inclined lid that is downwardly inclined in an insertion direction of the washing unit 400. In brief, the inclined rib and the inclined lid come into close contact with each other as the washing unit 400 is inserted, thereby shielding the opening of the drawer cover 440. Additionally, to enhance shielding efficiency with the multi-stepped rib 442, a separate gasket may be positioned to come into contact with the multi-stepped rib 442.

Figure 8:
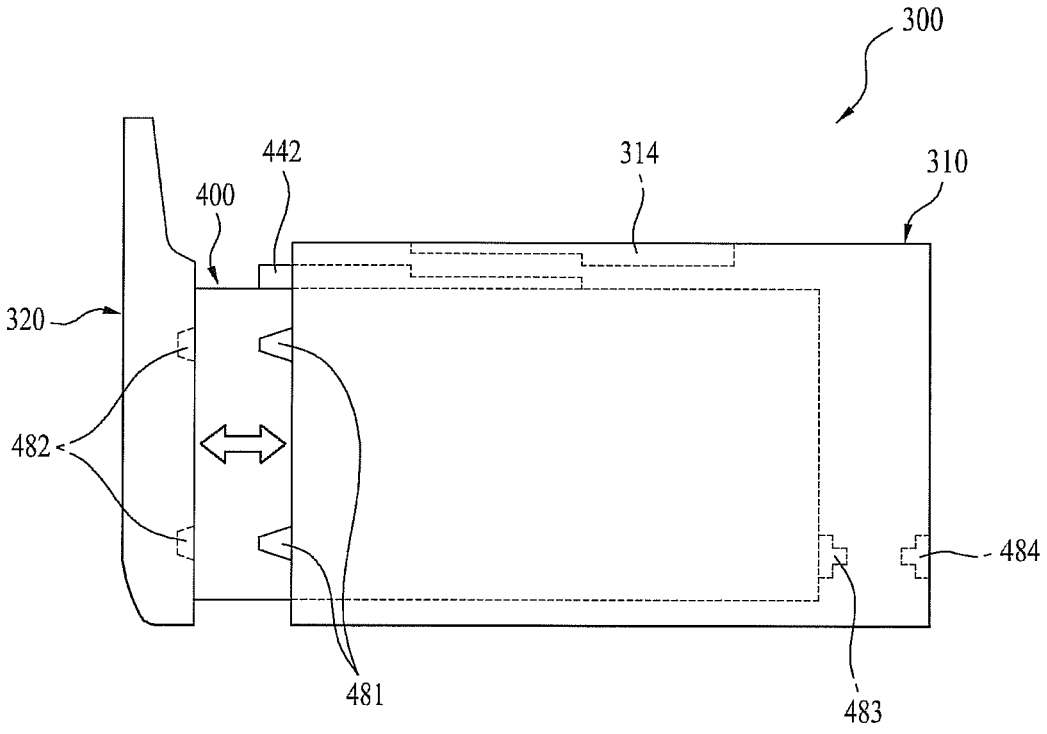
FIG. 8 is a side view showing an inserted state of the washing unit included in the auxiliary washing machine according to an embodiment of the present disclosure.

Hereinafter, an insertion configuration of the washing unit 400 will be described with reference to FIG. 8. FIG. 8 is a side view showing an inserted state of the washing unit included in the auxiliary washing machine according to an embodiment of the present disclosure.

A plurality of anti-shock bumps 481 may be formed at a front end of the second cabinet 310 and serves to absorb shock applied to the washing unit 400 when the washing unit 400 is inserted. The anti-shock bumps 481 may also be referred to herein as shock absorbers, rubber bumper, rubber feet, or the like.

Withdrawal of the drawer 410 of the washing unit 400 is guided by the lateral rail units 313 and the lower rail unit 315. Here, if the washing unit 400 is inserted into the second cabinet 310, the washing unit 400 may collide with the second cabinet 310 due to insertion inertia of the drawer 410. This collision may be transmitted to the respective components of the washing unit 400, causing damage to the components of the washing unit 400 and generating noise.

The anti-shock bumps 481 are formed at the front end of the second cabinet 310. Each of the anti-shock bumps 481 takes the form of a trapezoid having a circular cross section. In an exemplary configuration, the anti-shock bumps 481 may be formed of an elastic material for shock absorption. Thus, in the embodiment of the present disclosure, the anti-shock bumps 481 may be formed of rubber. Additionally, insertion recesses 482 for insertion of the anti-shock bumps 481 may be formed in an inner surface of the front panel 320 of the washing unit 400.

A locking device 483 is provided between a rear surface of the drawer 410 of the washing unit 400 and a rear panel of the second cabinet 310 and serves to prevent the inserted washing unit 400 from being unintentionally discharged. In the case in which the washing unit 400 is inserted into the second cabinet 310 so as to be stored in the second cabinet 310, the washing unit 400 may be sufficiently secured by coupling force of the locking device provided at the front panel 320. However, while the washing unit 400 is treating laundry, vibration is generated as the rotating tub 430 is rotated. This vibration is not sufficiently controlled using only the locking device provided at the front panel 320 and causes vibration of the entire laundry treatment apparatus 100. Hence, the locking device 483 is provided to continuously secure the washing unit 400 in position during operation of the washing unit 400.

The locking device 483 is mounted to a lower portion of the rear surface of the drawer 410, and a securing protrusion 484 is formed at a lower portion of an inner rear surface of the second cabinet 310 for engagement with the locking device 483. Here, the locking device 483 is controlled by a separate drive device so as to be forcibly secured by the securing protrusion 484 when power is applied thereto.

Referring again to FIGS. 5 and 6, the bearing housing 450 is located below the moving piece 423 of the tub structure 420 and rotatably supports the rotating shaft 431 of the rotating tub 430 penetrating the moving piece 423. The bearing housing 450 may have a center hole for passage of the rotating shaft 431, and a plurality of bearings is provided in the center hole to support the rotating shaft 431. In addition, the bearing housing 450 is provided at an outer circumferential surface thereof with first, second, and third bracket coupling portions 451*a*, 451*b* and 451*c*, which respectively extend toward the first, second, and third holders 425*a*, 425*b* and 425*c* formed at the drawer 410. Here, the first bracket coupling portion 451*a* extends to the front surface of the drawer 410 at which the first holder 425*a* is formed, and the second and third bracket coupling portions 451*b* and 451*c* extend, respectively, toward the second and third holders 425*b* and 425*c* formed in the rear drawer spaces 412 of the drawer 410. The motor 452 is provided below the bearing housing 450 and coupled to the rotating shaft 431 so as to rotate the rotating shaft 431.

The suspension assembly 460 is provided between the first, second and third holders 425*a*, 425*b* and 425*c* of the drawer 410 and the first, second and third bracket coupling portions 451*a*, 451*b* and 451*c* of the bearing housing 450. The suspension assembly 460 supports the bearing housing 450 as well as the respective components connected to the bearing housing 450 such that these components float with respect to the drawer 410.

Figure 9:
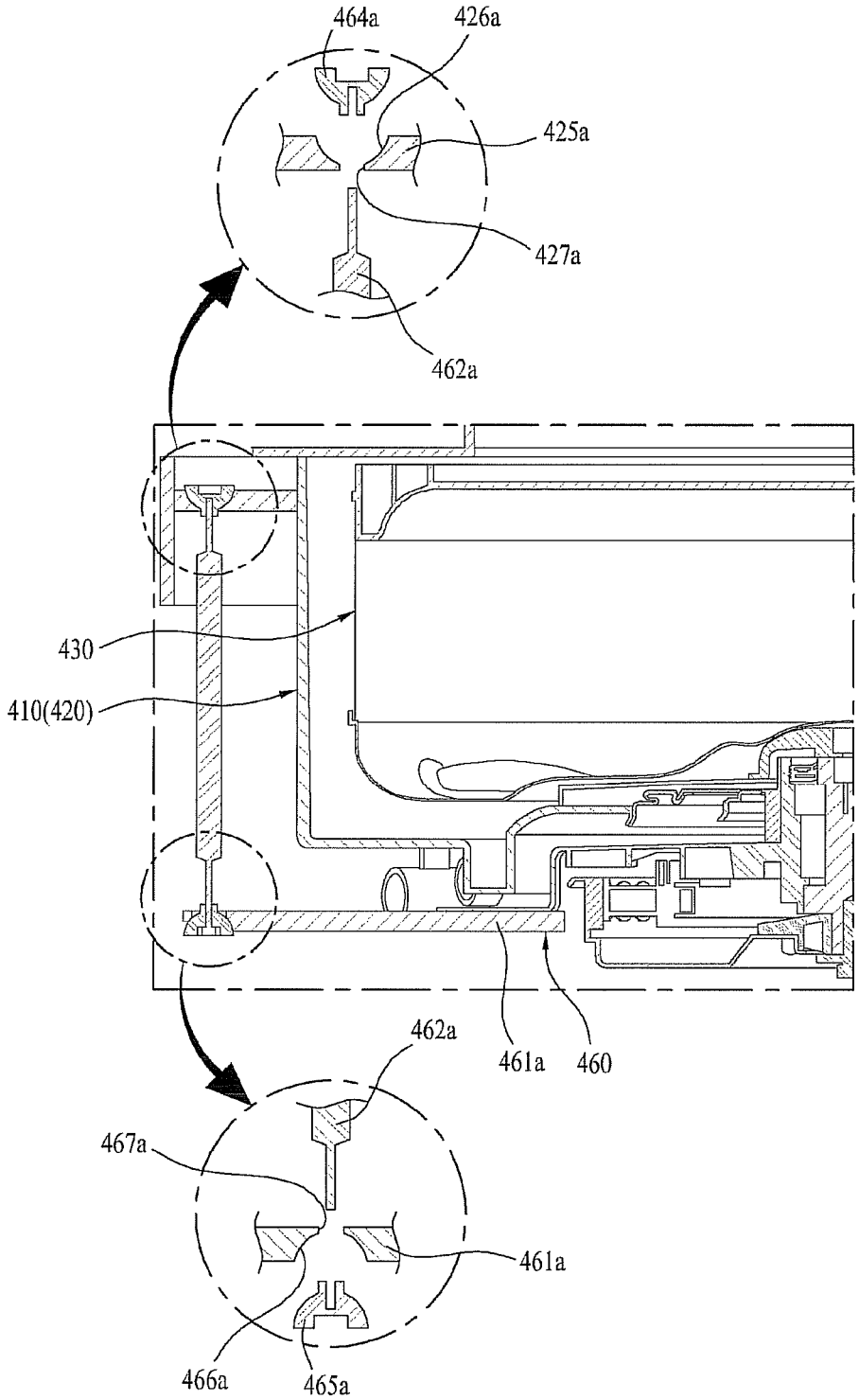
FIG. 9 is a sectional view showing a suspension configuration of the auxiliary washing machine according to an embodiment of the present disclosure.
Figure 10:
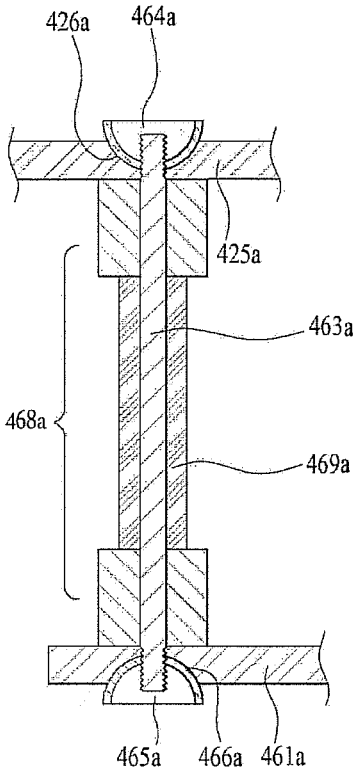
FIG. 10 is a bottom view showing a suspension configuration of the auxiliary washing machine according to an embodiment of the present disclosure.

Hereinafter, the suspension assembly 460 will be described with reference to FIGS. 9 and 10. FIG. 9 is a sectional view showing a suspension configuration of the auxiliary washing machine according to an embodiment of the present disclosure, and FIG. 10 is a bottom view showing the suspension configuration of the auxiliary washing machine according to the embodiment of the present disclosure.

A laundry treatment apparatus according to the related art includes suspension mechanism, such as a cylinder and piston, or a spring and damper, to support the drum and the tub and to reduce vibration caused during rotation of the drum. The suspension mechanism according to the related art supports the drum and the tub by being extended or contracted according to the weight of the drum and the tub, thereby causing the drum and the tub to be raised or lowered by a predetermined distance or more.

Accordingly, as described above, similar to the auxiliary washing machine 300 according to the embodiment of the present disclosure, the suspension mechanism of the related art is limited as to installation and driving thereof if the second cabinet 310 has a narrow interior space. The suspension assembly 460 for use with the second washing machine 300 according to the above-described embodiments will be described hereinafter. The suspension assembly 460 is provided at the washing unit 400 independently of the drawer 410 (more particularly, the tub structure 420) and a vibration transmission side. The suspension assembly 460 serves to support the bearing housing 450 that rotatably supports the rotating tub 430 and to attenuate vibration caused by rotation of the rotating tub 430.

The rotating tub 430, the moving piece 423, and the bearing housing 450 according to the present disclosure are substantially separated from the drawer 410 (more particularly, the tub structure 420 integrated with the drawer 410). The tub structure 420 is configured to define a water storage space under assistance of the moving piece 423 and the moving gasket 424. That is, the above-described bearing housing 450, and the moving piece 423 and the rotating tub 430 supported by the bearing housing 450 are supported in a floated state within the drawer 410 by the suspension assembly 460.

The suspension assembly 460 of the second washing machine 300 according to the present disclosure, as exemplarily shown in FIGS. 9 and 10, includes first, second and third brackets 461*a*, 461*b* and 461*c* coupled respectively to the first, second and third bracket coupling portions 451*a*, 451*b* and 451*c*, and first, second and third support bars 462*a*, 462*b* and 462*c* that connect the first, second and third brackets 461*a*, 461*b* and 461*c* and the first, second and third holders 425*a*, 425*b* and 425*c* to each other.

The three brackets 461*a*, 461*b* and 461*c* or the combination of the three brackets with corresponding bracket coupling portions 451*a*, 451*b* and 451*c* may be referred to herein as lower brackets. The three holders 425*a*, 425*b* and 425*c* may be referred to herein as upper brackets. The first, second and third brackets 461*a*, 461*b* and 461*c*, or the first, second and third holders 425*a*, 425*b* and 425*c* as described above have substantially the same configuration, and may differ from one another only in terms of installation positions thereof.

Accordingly, the first bracket 461*a*, the first holder 425*a*, and the first support bar 462*a* provided between the first bracket 461*a* and the first holder 425*a* will hereinafter be described as a representative configuration.

Hereinafter, the support bar 462*a* according to an embodiment of the present disclosure will be described in detail with reference to FIG. 9. FIG. 9 is a sectional view showing a configuration of the first support bar according to an embodiment of the present disclosure.

As exemplarily shown in FIG. 9, the semispherical recess 426*a* having the center through-hole 427*a* is indented from an upper surface of the first holder 425*a*. A semispherical recess 466*a* having a center through-hole 467*a* is indented from a lower surface of the first bracket 461*a*.

The first support bar 462*a* includes a support body 463*a* having a predetermined length, an upper semispherical support piece 464*a* that is fixed to an upper end of the support body 463*a* and configured to be seated in the semispherical recess 426*a* of the first holder 425*a*, and a lower semispherical support piece 465*a* that is fixed to a lower end of the support body 463*a* and configured to be seated in the semispherical recess 466*a* of the first bracket 461*a*. The upper semispherical support piece 464*a* and corresponding recess 426*a* may also have a ball and socket configuration.

More specifically, the first bracket 461*a* is suspended from the first holder 425*a* of the drawer body 411 by the first support bar 462*a*. Accordingly, through vibration of the rotating tub 430, the moving piece 423 and the bearing housing 450, which are adapted to support the rotating tub 430, are subjected to conical vibration via the first support bar 462*a*.

Here, friction occurs between the semispherical recess 426*a* of the first holder 425*a* and the upper semispherical support piece 464*a* of the first support bar 462*a*. Likewise, friction occurs between the lower semispherical support piece 465*a* of the first support bar 462*a* and the semispherical recess 466*a* of the first bracket 461*a*. As such, vibration of the rotating tub 430 may alleviate vibration of the moving piece 423 and the bearing housing 450 that are used to support the rotating tub 430. The lower semispherical support piece 465*a* and corresponding recess 466*a* may also have a ball and socket configuration.

The above-described first support bar 462*a* may further include a separate elastic member configured to restrict upward movement of the bearing housing 450. To this end, the separate tension member may be configured to apply tensile force between the first holder 425*a* and the first bracket 461*a*.

Hereinafter, the first support bar 462*a* will be described in detail with reference to FIGS. 11 and 12. The second and third support bars 462*b* and 462*c* may also include features as described below, for example, features of elastic member 468*a* described below with reference to the first support bar 462*a* may also apply to elastic members 468*b* and 468*c* which correspond to the second and third support bars 462*b* and 462*c*, respectively.

Figure 11:
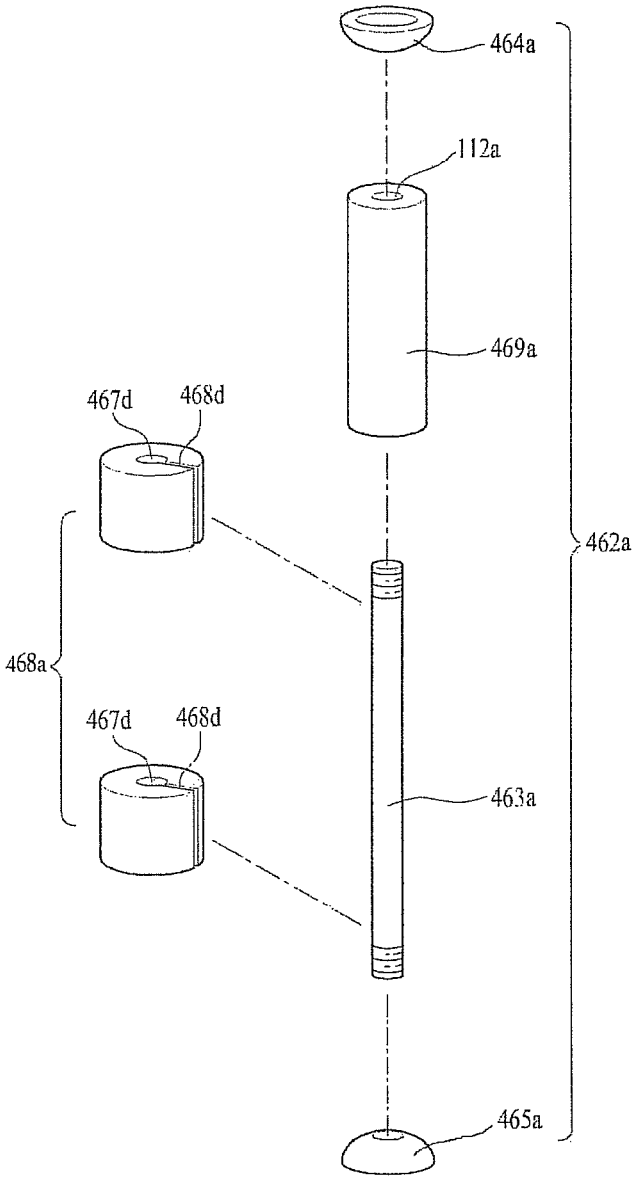
FIG. 11 is a sectional view showing a suspension configuration of the auxiliary washing machine according to another embodiment of the present disclosure.
Figure 12:
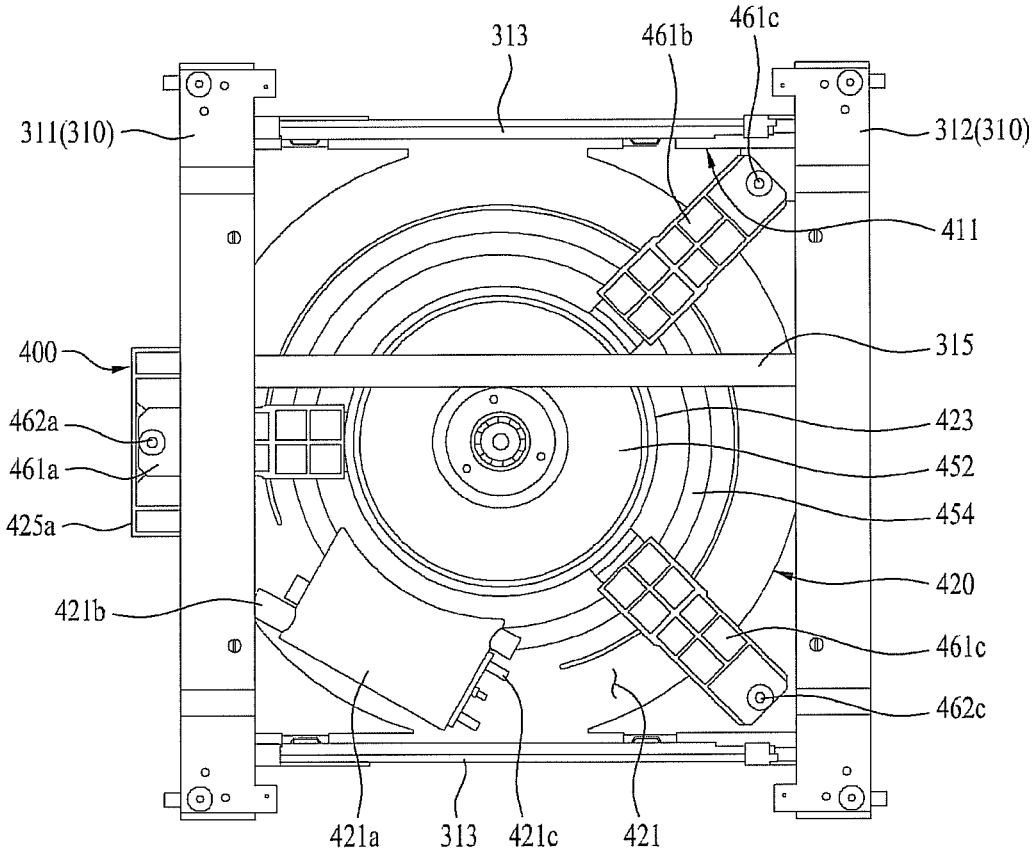
FIG. 12 is a sectional view showing a suspension configuration of the auxiliary washing machine according to another embodiment of the present disclosure.

As exemplarily shown in FIG. 11, the first support bar 462*a* may further include a strength increasing shaft 469*a* configured to increase the strength of the support body 463*a*, and a pair of elastic members 468*a* coupled to the support body 463*a* to apply pressure to the first bracket 461*a* and the first holder 425*a*, respectively, such that the first bracket 461*a* and the first holder 425*a* may be pushed toward the upper semispherical support piece 464*a* and the lower semispherical support piece 465*a*.

Here, the strength increasing shaft 469*a* serves to prevent deformation of the support body 463*a*. To this end, the strength increasing shaft 469*a* may centrally have a bore into which the support body 463*a* is inserted and secured in position. The strength increasing shaft 469*a* may be a columnar sleeve, for example, as illustrated. As such, the support body 463*a* may be press-fitted into the strength increasing shaft 469*a*.

More specifically, since the first support bar 462*a* functions to alleviate vibration to be transmitted to the bearing housing 450 during driving of the rotating tub 430, the first support bar 462*a* may have a risk of deformation after long-term operation of the auxiliary washing machine 300. The strength increasing shaft 469*a* may prevent deformation of the support body 463*a*.

The elastic members 468*a* may serve not only to maintain a distance between the first holder 425*a* and the first bracket 461*a*, but also to increase frictional force between the semispherical recess 426*a* of the first holder 425*a* and the upper semispherical support piece 464*a* and between the semispherical recess 466*a* of the first bracket 461*a* and the lower semispherical support piece 465*a*, respectively.

The elastic members 468*a* may be located respectively at upper and lower ends of the strength increasing shaft 469*a*. The elastic members 468*a* are configured to push the first holder 425*a* toward the upper semispherical support piece 464*a* with a predetermined magnitude of elastic force and to push the first bracket 461*a* toward the lower semispherical support piece 465*a* with a predetermined magnitude of elastic force.

The first bracket 461*a* is suspended from the first holder 425*a* of the drawer body 411 by the first support bar 462*a*. Accordingly, through vibration of the rotating tub 430, the moving piece 423 and the bearing housing 450, which are adapted to support the rotating tub 430, are subjected to conical vibration via the first support bar 462*a*.

In this case, friction occurs between the semispherical recess 426*a* of the first holder 425*a* and the upper semispherical support piece 464*a* of the first support bar 462*a*. Likewise, friction occurs between the lower semispherical support piece 465*a* of the first support bar 462*a* and the semispherical recess 466*a* of the first bracket 461*a*.

As such, vibration of the rotating tub 430 may alleviate vibration of the moving piece 423 and the bearing housing 450 that are used to support the rotating tub 430.

Here, the first holder 425*a* and the first bracket 461*a* may be brought into close contact with the upper semispherical support piece 464*a* and the lower semispherical support piece 465*a* by the pair of elastic members 468*a*, thereby alleviating vibration of the bearing housing 450 with greater friction force under assistance of the elastic members 468*a*.

Additionally, frictional members that provide a predetermined level of friction may be provided at surfaces of the upper and lower semispherical support pieces 464*a* and 465*a*, a surface of the semispherical recess 426*a* of the first holder 425*a*, and a surface of the semispherical recess 466*a* of the first bracket 461*a*, in order to enhance frictional force therebetween and to provide shock absorption effects. The frictional members may be surface patters, protrusions, or the like that increase the frictional forces.

The first support bar 462*a* of the suspension assembly 460 may maintain a distance between the rotating tub 430 and the tub structure 420 integrated with the drawer 410 within a predetermined range. That is, the first support bar 462*a* may prevent the rotating tub 430 and the tub structure 420 from moving away from each other beyond the predetermined range, or from approaching to each other beyond the predetermined range. In addition, the suspension assembly 460 according to the present embodiment may restrict movement of the rotating tub 430, thereby alleviating horizontal vibration and/or vertical vibration caused by rotation of the rotating tub 430.

Through rotation of the rotating tub 430, the rotating tub 430 and the bearing housing 450 may vibrate in various directions. For example, the rotating tub 430 and the bearing housing 450 may vibrate in a vertical direction, or may vibrate in a horizontal direction. In addition, even in the case in which the rotating tub 430 and the bearing housing 450 vibrate in the vertical direction, this vibration may occur along a linear path, or may occur along a curvilinear path. This also applies to vibration of the rotating tub 430 and the bearing housing 450 in the horizontal direction.

In addition, during rotation of the rotating tub 430, the rotating tub 430 is rarely rotated in any one direction, and in many cases, the vibration of the rotating tub 430 occurs with complex components. For example, the rotating tub 430 may horizontally vibrate in a curvilinear direction while performing vertical vibration.

In the case in which the first support bar 462*a* restricts downward movement and horizontal movement of the bearing housing 450, the first support bar 462*a* may simultaneously restrict upward movement of the bearing housing 450. Note that the first support bar 462*a* mainly restricts downward movement and horizontal movement of the bearing housing 450, and upward movement of the bearing housing 450 may be restricted by the weight of the bearing housing 450 as well as the weight of the moving pieces 423 and the rotating tub 430 coupled to the bearing housing 450.

Meanwhile, withdrawal or insertion of the auxiliary washing machine 300 using the drawer 410 has several problems. The auxiliary washing machine 300 essentially includes a water supply pipe for supply of wash water into the tub structure 420 integrated with the drawer 410 and a drainpipe for drainage of wash water.

When the washing unit 400 of the auxiliary washing machine 300 is withdrawn, the drawer body 411 and the tub structure 420 of the auxiliary washing machine 300 are withdrawn. In this case, the water supply pipe and the drainpipe connected to the tub structure 420 must be extended. Accordingly, there is a need for a configuration of extending and contracting the water supply pipe and the drainpipe in response to withdrawal or insertion of the washing unit 400.

If the water supply pipe and the drainpipe are not efficiently arranged, there is a problem in that the water supply pipe and the drainpipe are caught by the rear surface of the drawer 410 when the drawer 410 is inserted. In addition, there is a risk of the water supply pipe and the drainpipe being torn or damaged by the drawer 410. Hence, the laundry treatment apparatus 100 according to the present disclosure includes a water supply/drain unit 470 installed in an extendable manner to the rear surface of the drawer 410.

Figure 13:
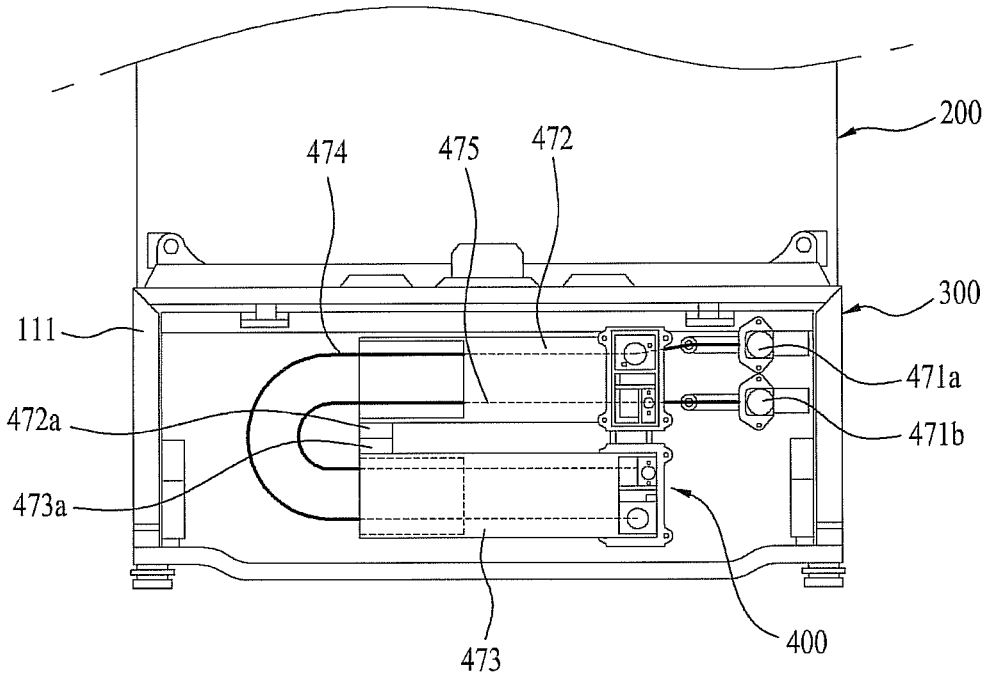
FIG. 13 is a rear view showing a water supply/drain configuration of the auxiliary washing machine according to an embodiment of the present disclosure.

Hereinafter, the water supply/drain unit 470 according to the present disclosure will be described in detail with reference to the accompanying drawings. FIG. 13 is a rear view showing a water supply/drain configuration of the auxiliary washing machine according to an embodiment of the present disclosure, and FIG. 14 is a side view showing the water supply/drain configuration of the auxiliary washing machine according to the embodiment of the present disclosure.

Figure 14:
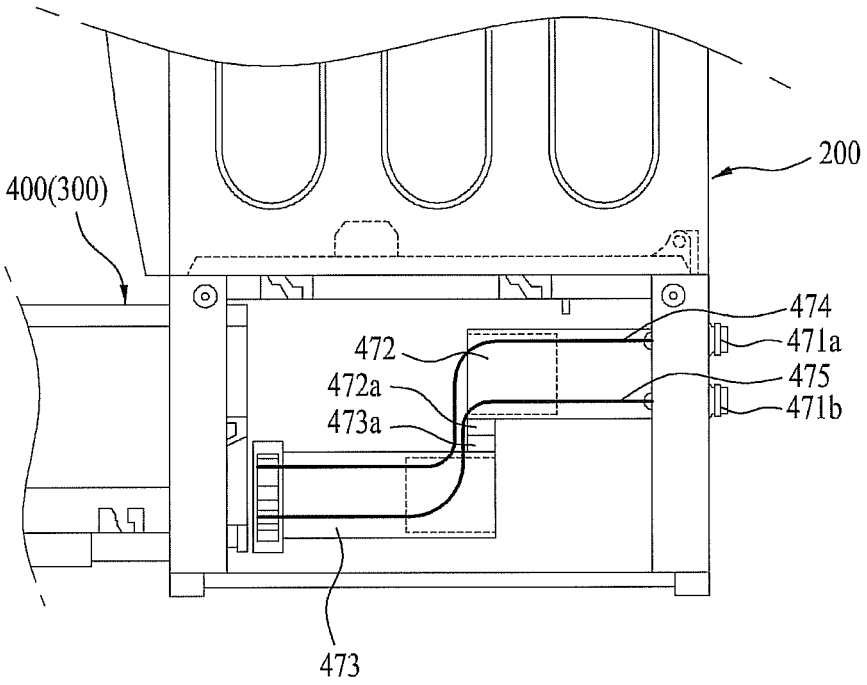
FIG. 14 is a side view showing a water supply/drain configuration of the auxiliary washing machine according to an embodiment of the present disclosure.

Referring to FIGS. 13 and 14, the water supply/drain unit 470 includes a first link 472, and a second link 473 located below the first link 472. The first link 472 and the second link 473 are pivotally hinged to each other. In an exemplary configuration, the first link 472 may be located above the second link 473.

In addition, in an exemplary configuration, longitudinal axes of the first and second links 472 and 473 may be parallel to a width direction of the second cabinet 310. That is, the second cabinet 310 in which the drawer 410 is placed has a longer width than a height thereof. As such, in an exemplary configuration, in terms of space utilization, the longitudinal axes of the first and second links 472 and 473 may be parallel to the width direction of the second cabinet 310 and the first and second links 472 and 473 may be arranged one above another.

The first link 472 and the second link 473 have a symmetrical shape and configuration. Thus, in the following description, the same components as those in the first link 472 among components of the second link 473 will not be described.

The first link 472 internally defines a space and has both ends open. A flexible water supply pipe 474 and a flexible drainpipe 475 are inserted through the open ends of the first link 472. That is, the flexible water supply pipe 474 and the flexible drainpipe 475 of the auxiliary washing machine 300 are accommodated in the interior space.

One end of the first link 472 is coupled to a rear panel of the second cabinet 310. In addition, the first link 472 is pivotally rotatably coupled to the rear panel of the second cabinet 310. More specifically, one end of the first link 472 is hinged to the first bracket 461*a*, and in turn the first bracket 461*a* is coupled to the rear panel. Here, the first link 472 may rotate horizontally at the rear panel when the drawer is pulled out.

The second link 473 may be mounted below the first link 472. The second link 473 has the same configuration and shape as the first link 472. One end of the second link 473 is hinged to a housing rear surface of the drawer 410.

A first connector 472*a* may be provided below the first link 472, and a second connector 473*a* may be provided above the second link 473. The first connector 472*a* and the second connector 473*a* are respectively integrated with the first link 472 and the second link 473.

A water supply port 471*a* is formed at an upper portion of the rear surface of the second cabinet 310. The water supply port 471*a* communicates with the flexible water supply pipe 474. The flexible water supply pipe 474 is inserted into the first link 472 and the second link 473. The entire flexible water supply pipe 474 may have a U-shaped form. That is, the flexible water supply pipe 474 may be inserted into one end of the first link 472 and emerge from the other end. In addition, the flexible water supply pipe 474, emerging from the other end of the first link 472, may be inserted into one end of the second link 473 and emerge from the other end. In addition, the flexible water supply pipe 474, emerging from the other end of the second link 473, may penetrate the rear surface of the second cabinet 310 to thereby be connected to the auxiliary washing machine 300.

The flexible drainpipe 475 is installed in the same manner as the flexible water supply pipe 474. That is, in an exemplary configuration, the flexible drainpipe 475 may be arranged in a U-shaped form within the first link 472 and the second link 473. An end of the flexible drainpipe 475 may emerge from the rear surface of the second cabinet 310. That is, a drain portion of the flexible drainpipe 475, from which wash water is discharged outward, is located at the outside of the second cabinet 310.

The flexible water supply pipe 474 and the flexible drainpipe 475 may be formed of a pliable material that may bend according to pivotal rotation of the first and second links 472 and 473 of the water supply/drain unit 470. Moreover, the first link 472 and the second link 473 may guide a control line. The control line may include an electric wire or a control cable.

Referring to FIG. 13, in a state in which the drawer 410 is completely inserted, the first link 472 and the second link 473 are stacked one above another so as to be arranged in the same vertical plane. That is, the first link 472 and the second link 473 may be arranged parallel to the rear surface of the second cabinet 310. In addition, the flexible water supply pipe 474 and the flexible drainpipe 475 are bent in, for example, a U-shaped form near a hinge coupling position of the first link 472 and the second link 473. That is, the flexible water supply pipe 474 and the flexible drain pipe 475, emerging from one end of the first link 472, are gently bent and inserted into one end of the second link 473.

Referring to FIG. 14, if the drawer 410 is withdrawn, the first link 472 and the second link 473, which are coupled to the drawer 410, are no longer located in the same vertical plane. More specifically, the first link 472 is pivoted about a position thereof where the first link 472 is coupled to the rear panel of the second panel 310, and the second link 473 is pivoted about a position thereof where the second link 473 is coupled to the second cabinet 310. In particular, the second link 473 is pivoted about the coupling position thereof with respect to the second cabinet 310 as well as a coupling position thereof with respect to the first link 472. On the other hand, the first link 472 is pivoted about only the coupling position thereof with respect to the rear panel.

In a completely withdrawn state of the drawer 410, the first link 472 and the second link 473 may again be located in the same vertical plane. However, the second link 473 is not located immediately below the first link 472, but is located in a diagonal direction of the first link 472. In an exemplary configuration, the first link 472 and the second link 473 may maintain a predetermined angle therebetween in a completely withdrawn state of the drawer 410, rather than being located in the same vertical plane. In other words, if the first link 472 and the second link 473 are located in the same vertical plane in a completely withdrawn state of the drawer 410, the first link 472 and the second link 473 may fail to pivotally rotate relative to each other when the drawer 410 is again inserted. That is, the first link 472 and the second link 473 located in the same vertical plane cannot generate moment for rotation of the first and second links 472 and 473. Hence, maintaining the predetermined angle between the first link 472 and the second link 473 in a completely withdrawn state of the drawer 410 ensures easy rotation of the first and second links 472 and 473 when the drawer 410 is inserted.

As such, according to the present disclosure, it is possible to effectively arrange the water supply pipe and the drainpipe of the auxiliary washing machine using the hinge assembly consisting of the pair of links. This may prevent the water supply pipe and the drain pipe from being twisted or damaged when the drawer is inserted or withdrawn.

As is apparent from the above description, according to embodiments of the present disclosure, as a result of providing an auxiliary washing machine in addition to a main washing machine, a clothes treatment apparatus having a function of raising an installation position of the main washing machine may be accomplished.

Further, according to embodiments of the present disclosure, the auxiliary washing machine may have an improved configuration to increase a washing capacity thereof. Furthermore, according to embodiments of the present disclosure, the auxiliary washing machine may have an improved configuration to generate less vibration and noise. In addition, according to embodiments of the present disclosure, the auxiliary washing machine may have an improved configuration to ensure easy installation of inner components thereof even if the auxiliary washing machine has a narrow interior space.

To achieve these objects and other advantages and in accordance with the purpose of the disclosure, as embodied and broadly described herein, an auxiliary washing machine may include a cabinet that defines an accommodation space, a washing unit (or washing device) configured to be withdrawn from the cabinet, and a front panel that is located in front of the washing unit and defines a front external appearance of the auxiliary washing machine, wherein the washing unit includes a drawer configured to be accommodated in the accommodation space of the cabinet, the drawer defining a space for storage of wash water, a rotating structure placed within the drawer, the rotating structure having a rotating shaft penetrating the drawer so as to treat laundry, and a suspension assembly configured to support vertical load of the rotating structure such that the rotating structure is supported to float with respect to the drawer and to alleviate horizontal vibration of the rotating structure.

The drawer may include a drawer body corresponding to the accommodation space of the cabinet and a tub structure placed within the drawer body such that wash water is stored in the tub structure. The tub structure may include a ring-shaped bottom portion defining a bottom surface of the tub structure, the bottom portion having a center aperture, and a moving piece (or rotatable device) located in the aperture of the bottom portion so as to be movable relative to the bottom portion.

A bearing housing may be located below the moving piece so as to support the rotating shaft, and the suspension assembly may support the bearing housing such that the bearing housing is mounted to the drawer body.

The suspension assembly may support the bearing housing at three or more positions relative to the drawer body. The bearing housing may include three or more bracket coupling portions (or lower brackets) radially extending from the bearing housing, the drawer body may include three or more holders (or upper brackets) arranged at positions corresponding to the respective bracket coupling portions, and a suspension assembly may be provided between the bracket coupling portions and the holders to support the bearing housing in a floating state. Moreover, a motor may be provided below the bearing housing to rotate the rotating shaft. Each of the bracket coupling portions may be bent downward to extend by a length equal to a thickness of the motor so as to define a space for installation of the motor.

The suspension assembly may include a bracket coupled to each of the bracket coupling portions, and a support bar having an upper end rotatably coupled to the holder and a lower end rotatably connected to the bracket. The holder may have a semispherical recess in which the upper end of the support bar is seated and the bracket may have a semispherical recess in which the lower end of the support bar is seated.

The support bar may include a support body having a predetermined length, an upper semispherical support piece that is coupled to an upper end of the support body and configured to be seated in the semispherical recess of the holder, and a lower semispherical support piece that is coupled to a lower end of the support body and configured to be seated in the semispherical recess of the bracket.

A strength increasing member may be coupled to the support bar to increase strength of the support bar. The support bar may further include an elastic member coupled thereto to push the holder toward the upper semispherical support piece and the bracket toward the lower semispherical support piece.

Each of the upper semispherical support piece and the lower semispherical support piece may be provided with a frictional member to increase frictional force. Moreover, each of the upper semispherical support piece and the lower semispherical support piece may be provided with an elastic member for shock absorption.

The drawer body may take the form of a rectangular box corresponding to the accommodation space, and the tub structure may have a cylindrical shape. A drawer space may be defined between an outer circumferential surface of the tub structure and each corner of the drawer body.

A first holder may be located at a front surface of the drawer body and second and third holders may be located respectively in the drawer spaces defined in both rear regions of the drawer body, first, second and third bracket coupling portions may extend in a radial direction of the bearing housing so as to correspond to the first, second and third holders, and the suspension assembly may support the bearing housing in a floated state between the respective bracket coupling portions and the respective holders.

A moving gasket may be provided between the bottom portion and the moving piece and configured to seal a gap between the bottom portion and the moving piece and to allow the moving piece to be movable relative to the bottom portion.

The rotating structure may be a rotating tub (or rotating drum) rotatably placed within the tub structure. The rotating structure may be a pulsator rotatably provided at an inner bottom surface of the tub structure. The rotating structure may also be separated from and supported by the drawer in terms of vibration.

In accordance with another aspect of the present disclosure, a clothes treatment apparatus may include a main washing machine configured to treat laundry and an auxiliary washing machine located at one side of the main washing machine, wherein the auxiliary washing machine includes a frame defining an accommodation space, a drawer configured to be accommodated in the accommodation space, the drawer defining a space for storage of wash water, a rotating structure placed within the drawer, the rotating structure having a rotating shaft penetrating the drawer so as to treat laundry, a suspension assembly configured to support vertical load of the rotating structure such that the rotating structure is supported to float with respect to the drawer and to alleviate horizontal vibration of the rotating structure, and a front panel located in front of the drawer, the front panel defining a front external appearance of the auxiliary washing machine.

The main washing machine and the auxiliary washing machine may be installed within a single cabinet defining a single space, and the single cabinet may include a partition to separate an installation space for the main washing machine from an installation space for the auxiliary washing machine.

The main washing machine may include a first cabinet that defines an external appearance of the main washing machine, and the auxiliary washing machine may include a second cabinet that defines an external appearance of the auxiliary washing machine and is configured to support the first cabinet.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a cabinet that defines an accommodation space;

a washing device configured to be withdrawn from the accommodation space of the cabinet; and a front panel provided in front of the washing device that defines a front external appearance of the washing machine, wherein the washing device includes:

a drawer configured to be slidably inserted or withdrawn from the accommodation space of the cabinet, the drawer including a tub placed within the drawer body such that wash water is stored in the tub, a bottom portion defining a bottom surface of the tub and the bottom portion having a center aperture, and a plurality of upper brackets that extend from the drawer body;

a rotating drum assembly provided in the drawer, the rotating drum assembly having a drum and a rotating shaft connected to the drum and extending through the tub;

a rotatable device provided in the aperture of the bottom portion that moves relative to the bottom portion;

a bearing housing provided under the rotatable device to support the rotating shaft, and the bearing housing including a plurality of lower brackets that extend radially from a body of the bearing housing at positions corresponding to respective upper brackets; and a suspension assembly configured to support the rotating drum assembly such that the rotating drum assembly is suspended relative to the tub and to dampen vibration from the rotating drum assembly, wherein the suspension assembly is provided between the lower brackets of the bearing housing and the upper brackets of the drawer to support the bearing housing in a floating state and the suspension assembly includes a support bar having an upper end rotatably coupled to each of the upper brackets and the lower end rotatably coupled to an extension portion of each of the lower brackets.

2. The washing machine according to claim 1, wherein the suspension assembly supports the bearing housing at three or more positions relative to the drawer body.

3. The washing machine according to claim 1, wherein a motor is provided below the bearing housing to rotate the rotating shaft.

4. The washing machine according to claim 3, wherein each of the lower brackets is bent downward to extend a prescribed amount corresponding to a thickness of the motor to form a recess for the motor.

5. The washing machine according to claim 1, wherein each of the upper brackets has a recess having a semispherical shape in which the upper end of the support bar is seated and each of the lower brackets has a recess having a semispherical shape in which the lower end of the support bar is seated.

6. The washing machine according to claim 5, wherein the recess on each of the upper brackets is formed on a top surface of each of the upper brackets and the recess on each of the lower brackets is formed on a bottom surface of each of the lower brackets, the recessed directions of the upper and lower recesses being opposite directions.

7. The washing machine according to claim 5, wherein the support bar includes a support body having a prescribed length, an upper support piece having a semispherical shape and coupled to an upper distal end of the support body, and a lower support piece having a semispherical shape and coupled to a lower distal end of the support body, wherein the upper support piece is seated in the semispherical recess of each of the upper brackets and the lower support piece is seated in the semispherical recess of each of the lower brackets.

8. The washing machine according to claim 7, wherein a columnar sleeve is coupled to the support bar to increase strength of the support bar.

9. The washing machine according to claim 7, wherein the support bar further includes an elastic member coupled thereto to push toward each of the upper brackets to apply a downward force to the upper semispherical support piece and to push toward each of the lower brackets to apply an upward force to the lower semispherical support piece.

10. The washing machine according to claim 7, wherein each of the upper semispherical support piece and the lower semispherical support piece is configured to increase frictional force between brackets and the support bar.

11. The washing machine according to claim 7, wherein each of the upper semispherical support piece and the lower semispherical support piece is provided with an elastic member for shock absorption.

12. The washing machine according to claim 1, wherein the drawer body has a rectangular shape that corresponds to the accommodation space and the tub has a cylindrical shape, gaps being formed between an outer circumferential surface of the tub and each corner of the drawer body.

13. The washing machine according to claim 12, wherein the plurality of upper brackets includes at least three upper brackets and the plurality of lower brackets includes at least three lower brackets, wherein a first upper bracket is provided at a front surface of the drawer body, and a second and a third upper brackets are provided in the gaps, wherein a first, a second and a third lower brackets extend radially from the bearing housing connected to the rotating shaft to correspond to the first, second and third upper brackets, respectively, and wherein the suspension assembly is connected between corresponding upper and lower brackets to support the bearing housing in a floating state.

14. The washing machine according to claim 3, wherein a gasket is provided between the bottom portion and the rotatable device, the gasket configured to seal a gap between the bottom portion and the rotatable device while allowing the rotatable device to move relative to the bottom portion.

15. The washing machine according to claim 1, wherein the drum assembly includes a pulsator rotatably provided at an inner bottom surface of the tub structure.

16. The washing machine according to claim 1, wherein the drum assembly is mounted to the drawer to be movable relative to the drawer to dampen vibration.

17. The washing machine according to claim 1, further including a main washing machine and an auxiliary washing machine, wherein the auxiliary washing machine includes the drawer, the washing device, and the suspension assembly, the auxiliary washing machine being provided adjacent to the main washing machine.

18. A laundry treatment apparatus comprising:

a main washing machine configured to treat laundry; and an auxiliary washing machine provided at one side of the main washing machine, wherein the auxiliary washing machine includes a frame that defines an accommodation space;

a drawer slidably attached to the frame in the accommodation space, the drawer having a drawer body corresponding to the accommodation space of the cabinet and a tub placed within the drawer body such that wash water is stored in the tub, a bottom portion defining a bottom surface of the tub and the bottom portion having a center aperture, and a plurality of upper brackets that extend from the drawer body;

a rotating drum assembly provided in the drawer, the rotating drum assembly having a rotating shaft that penetrates the drawer to rotate a drum;

a rotatable device provided in the aperture of the bottom portion that moves relative to the bottom portion;

a bearing housing provided under the rotatable device to support the rotating shaft, the suspension assembly supports the bearing housing such that the bearing housing is mounted to the drawer body, and the bearing housing including a plurality of lower brackets that extend radially from a body of the bearing housing at positions corresponding to the respective the upper brackets; and a suspension assembly configured to support a vertical load of the rotating drum assembly such that the rotating drum assembly is suspended relative to the tub and to dampen vibration from the rotating drum assembly in a lateral direction wherein the suspension assembly is provided between the lower brackets of the bearing housing and the upper brackets of the drawer to support the bearing housing in a floating state and the suspension assembly includes a support bar having an upper end rotatably coupled to each of the upper brackets and a lower end rotatably coupled to an extension portion of each of the lower brackets; and a front panel provided in the front of the drawer, the front panel defining a front external appearance of the auxiliary washing machine.

19. The laundry treatment apparatus according to claim 18, further including a cabinet provided around the main washing machine and the auxiliary washing machine, the cabinet including a partition that separates an installation space for the main washing machine from an installation space for the auxiliary washing machine.

20. The laundry treatment apparatus according to claim 18, wherein the main washing machine includes a first cabinet that defines an external appearance of the main washing machine, and the auxiliary washing machine includes a second cabinet that defines an external appearance of the auxiliary washing machine, the second cabinet configured to support the first cabinet.

* * * * *